US009144123B2

(12) United States Patent
Jeong

(10) Patent No.: US 9,144,123 B2
(45) **Date of Patent: *Sep. 22, 2015**

(54) LIGHT EMITTING DIODE DRIVER HAVING CASCODE STRUCTURE

(76) Inventor: Jae Hong Jeong, Saratoga, CA (US)

( * ) Notice: Subject to any disclaimer, the term of this patent is extended or adjusted under 35 U.S.C. 154(b) by 902 days.

This patent is subject to a terminal disclaimer.

(21) Appl. No.: 13/244,873

(22) Filed: Sep. 26, 2011

(65) Prior Publication Data

US 2012/0146514 A1 Jun. 14, 2012

Related U.S. Application Data

(60) Provisional application No. 61/422,128, filed on Dec. 11, 2010.

(51) Int. Cl.
*H05B 41/28* (2006.01)
*H05B 33/08* (2006.01)

(52) U.S. Cl.
CPC ..... *H05B 33/0815* (2013.01); *H05B 33/083* (2013.01); *H05B 33/089* (2013.01)

(58) Field of Classification Search
CPC ..... H01L 2924/12041; H05B 33/0827; H05B 33/0821; H05B 33/0815; H05B 33/0845; H05B 33/0884
USPC ..... 315/247, 185 S, 291, 307–326, 224, 225
See application file for complete search history.

(56) References Cited

U.S. PATENT DOCUMENTS 6,989,807 B2 1/2006 Chiang
7,081,722 B1 * 7/2006 Huynh et al. ..... 315/323
7,439,944 B2 10/2008 Huynh et al.
8,901,849 B2 * 12/2014 Jeong et al. ..... 315/294
2006/0175985 A1 8/2006 Huynh et al.
2006/0208669 A1 9/2006 Huynh et al.
2008/0116817 A1 5/2008 Chao et al.
2009/0128055 A1 * 5/2009 Shin et al. ..... 315/301
2010/0156307 A1 * 6/2010 Kim et al. ..... 315/224
2010/0194298 A1 8/2010 Kuwabara
2010/0265271 A1 * 10/2010 Chang et al. ..... 345/690
2010/0308738 A1 12/2010 Shteynberg et al.
2010/0308739 A1 12/2010 Shteynberg et al.
2011/0062872 A1 * 3/2011 Jin et al. ..... 315/122
2011/0273102 A1 11/2011 Van De Ven et al.

(Continued)

FOREIGN PATENT DOCUMENTS

JP 2007-123562 A 5/2007
JP 2007-173813 A 7/2007

(Continued)

*Primary Examiner* — Tuyet Vo
(74) *Attorney, Agent, or Firm* — Patent Office of Dr. Chung Park

(57) ABSTRACT

A driver circuit for driving light emitting diodes (LEDs). The driver circuit includes: a string of LEDs divided into n groups, the n groups of LEDs being electrically connected to each other in series, a downstream end of group m−1 being electrically connected to the upstream end of group m, where m is a positive number equal to or less than n. The driver circuit also includes a power source coupled to an upstream end of group 1 and operative to provide an input voltage and a plurality of current regulating circuits, each of the current regulating circuits being coupled to the downstream end of a corresponding group at one end and coupled to a ground at the other end and including a sensor amplifier and a cascode having first and second transistors.

33 Claims, 10 Drawing Sheets

(56) References Cited

U.S. PATENT DOCUMENTS

| | | | | |
|---|---|---|---|---|
| 2012/0081009 | A1 | 4/2012 | Shteynberg et al. | |
| 2012/0217887 | A1* | 8/2012 | Kang et al. | 315/193 |
| 2012/0229030 | A1* | 9/2012 | Moskowitz et al. | 315/122 |

FOREIGN PATENT DOCUMENTS

| | | | |
|---|---|---|---|
| JP | 2010-225742 | A | 10/2010 |
| KR | 10-2008-0034316 | A | 4/2008 |
| KR | 10-2009-0050381 | A | 5/2009 |
| KR | 10-0905844 | B1 | 7/2009 |
| KR | 10-2010-0067468 | A | 6/2010 |
| KR | 10-0973014 | B1 | 7/2010 |
| KR | 10-0997050 | B1 | 11/2010 |
| WO | 2012-034102 | A1 | 3/2012 |
| WO | 2012-061999 | A1 | 5/2012 |

* cited by examiner

LIGHT EMITTING DIODE DRIVER HAVING CASCODE STRUCTURE

CROSS REFERENCES

This application claims the benefit of U.S. Provisional Applications No. 61/422,128, filed on Dec. 11, 2010, entitled "Light emitting diode driver using turn-on voltage of light emitting diode," and relates U.S. application Ser. No. 13/244,892, filed on Sep. 26, 2011, issued as U.S. Pat. No. 8,890,432 on Nov. 18, 2014, entitled "Light emitting diode driver," and U.S. application Ser. No. 13/244,900, filed on Sep. 26, 2011, issued as U.S. Pat. No. 9,018,856 on Apr. 28, 2015, entitled "Light emitting diode driver having phase control mechanism," which are hereby incorporated by reference in their entirety.

BACKGROUND OF THE INVENTION

The present invention relates to a light emitting diode (LED) driver, and more particularly, to a circuit for driving a string of light emitting diode (LEDs).

Due to the concept of low energy consumption, LED lamps are prevailing and considered a practice for lighting in the era of energy shortage. Typically, an LED lamp includes a string of LEDs to provide the needed light output. The string of LEDs can be arranged either in parallel or in series or a combination of both. Regardless of the arrangement type, providing correct voltage and/or current is essential to efficient operation of the LEDs.

In application where the power source is periodic, the LED driver should be able to convert the time varying voltage to the correct voltage and/or current level. Typically, the voltage conversion is performed by circuitry commonly known as AC/DC converters. These converters, which employ an inductor or transformer, capacitor, and/or other components, are large in size and have short life, which results in an undesirable form factor in lamp design, high manufacturing cost, and reduction in system reliability. Accordingly, there is a need for an LED driver that is reliable and has a small form factor to thereby reduce the manufacturing cost.

SUMMARY OF THE INVENTION

In one embodiment of the present disclosure, a method for driving light emitting diodes (LEDs) includes: providing a string of LEDs divided into groups, the groups being electrically connected to each other in series; providing a power source electrically connected to the string of LEDs; coupling each of the groups to a ground through a separate current regulating circuit, the separate current regulating circuit including a cascode structure having first and second transistors; and increasing an input voltage from the power source to turn on the groups in a downstream sequence.

In another embodiment of the present disclosure, a driver circuit for driving light emitting diodes (LEDs) includes: a string of LEDs divided into n groups, the n groups of LEDs being electrically connected to each other in series, a downstream end of group m−1 being electrically connected to the upstream end of group m, where m being a positive number equal to or less than n; a power source coupled to an upstream end of group 1 and operative to provide an input voltage; a plurality of current regulating circuits, each of the current regulating circuits being coupled to the downstream end of a corresponding group at one end and coupled to a ground at the other end and including a cascode having first and second transistors and a sensor amplifier.

These and other features, aspects and advantages of the present invention will become better understood with reference to the following drawings, description and claims.

DETAILED DESCRIPTION OF THE INVENTION

Figure 1:
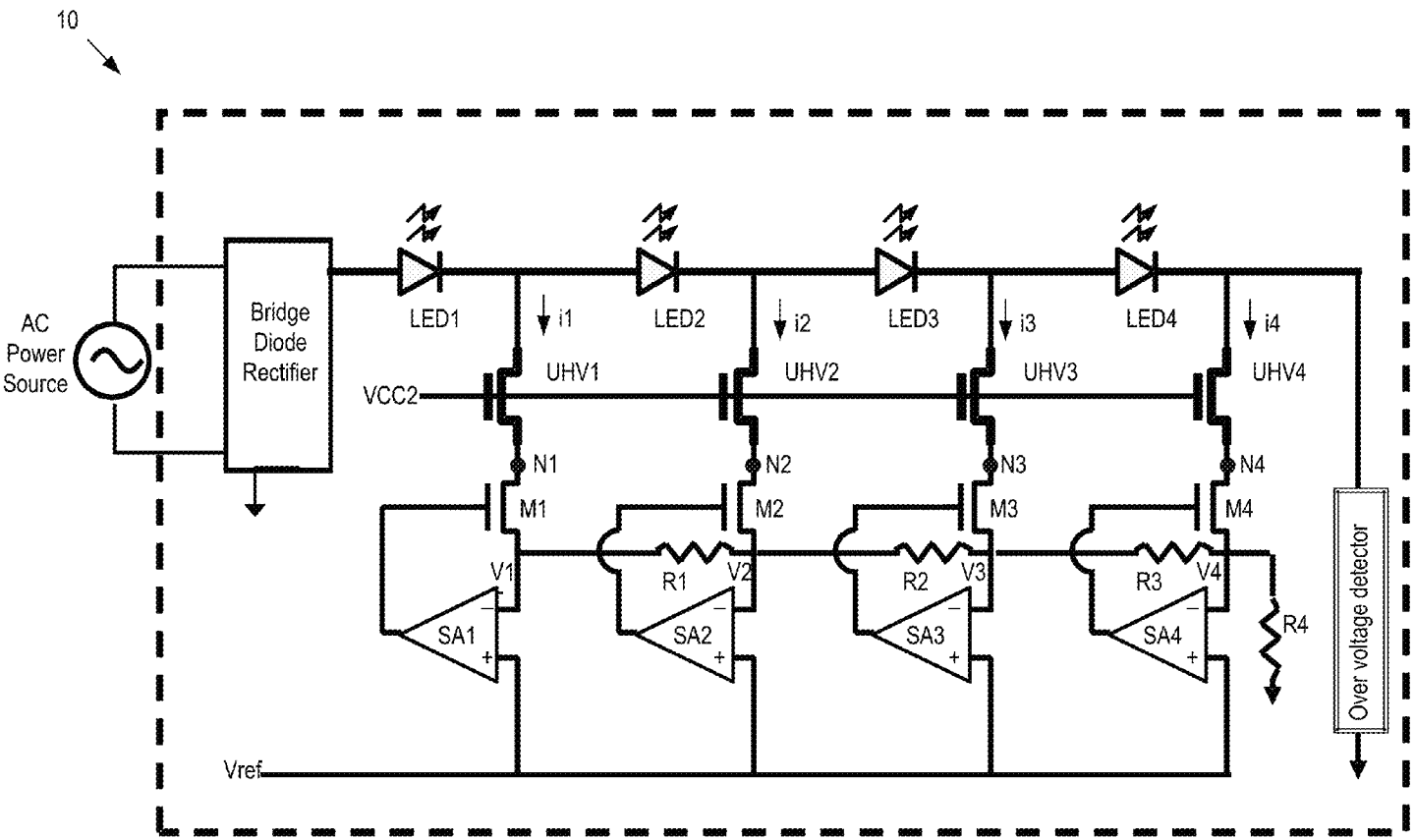
FIG. 1 shows a schematic diagram of an LED driver circuit in accordance with one embodiment of the present invention.

Referring now to FIG. 1, there is shown a schematic diagram of an LED driver circuit (or, shortly driver) 10 in accordance with one embodiment of the present invention. As depicted, the driver 10 is powered by a power source such as an alternative current (AC) power source. The electrical current from the AC power source is rectified by a rectifier circuit. The rectifier circuit can be any suitable rectifier circuit, such as bridge diode rectifier, capable of rectifying the alternating power from the AC power source. The rectified voltage Vrect is then applied to a string of light emitting diodes (LEDs). If desirable, the AC power source and the rectifier may be replaced by a direct current (DC) power source.

The LEDs as used herein is the general term for many different kinds of light emitting diodes, such as traditional LED, super-bright LED, high brightness LED, organic LED, etc. The drivers of the present invention are applicable to all kinds of LED.

As depicted in FIG. 1, a string of LEDs is electrically connected to the power source and divided into four groups. However, it should be apparent to those of ordinary skill in the art that the string of LEDs may be divided into any suitable number of groups. The LEDs in each group may be a combination of the same or different kind, such as different color. They can be connected in serial or parallel or a mixture of both. Also, one or more resistances may be included in each group.

A separate current regulating circuit (or, shortly regulating circuit) is connected to the downstream end of each LED group, where the current regulating circuit collectively refers to a group of elements for regulating the current flow, say i1, and includes a first transistor (say, UHV1), a second transistor (say, M1), and a sensor amplifier (say, SA1). Hereinafter, the term transistor refers to an N-Channel MOSFET, a P-Channel MOSFET, an NPN-bipolar transistor, a PNP-bipolar transistor, an Insulated gate Bipolar Transistor (IGBT), analog switch, or a relay.

The first and second transistors are electrically connected in series, forming a cascode structure. The first transistor is capable of shielding the second transistor from high voltages. As such, the first transistor is referred as shielding transistor hereinafter, even though its function is not limited to shielding the second transistor. The main function of the second transistor includes regulating the current i1, and as such, the second transistor is referred as regulating transistor hereinafter. The shielding transistor may be an ultra-high-voltage (UHV) transistor that has a high breakdown voltage of 500 V, for instance, while the regulating transistor M1 may be a low-voltage (LV), medium-voltage (MV), or a high-voltage (HV) transistor and has a lower breakdown voltage than the shielding transistor. The node, such as N1, refers to the point where the source of the shielding transistor is connected to the drain of the regulating transistor.

The sensor amplifier SA1, which may be an operational amplifier, compares the voltage V1 with the reference voltage Vref, and outputs a signal that is input to the gate of the regulating transistor, to thereby form a feedback control of the current i1 flowing through the cascode and the resistors R1, R2, R3, and R4. The gate voltage of the shielding transistor may be set to a constant voltage, Vcc2. (Hereinafter, Vcc2 refers to a constant voltage.) The mechanism for generating the constant gate voltage Vcc2 is well known in the art, and as such, the detailed description of the mechanism is not described in the present document.

As discussed above, each current regulating circuit is electrically connected to the downstream end of the corresponding LED group at one end and to the ground at the other end via the current sensing resistors. The voltages V1, V2, V3, and V4 represent the electrical potentials at the downstream ends of the regulating transistors M1, M2, M3, and M4, respectively. Thus, for instance, the voltage V1 can be represented by the equation:

$$V1=i1*(R1+R2+R3+R4)+i2*(R2+R3+R4)+i3*(R3+R4)+i4*R4.$$

The driver 10 can turn on/off each group of LEDs successively as the level of Vrect changes. As the voltage of the power source starts increasing from zero, Vrect may not be high enough to cause the electrical current to flow through the LEDs. At this stage, the voltages V1, V2, V3 and V4 are lower than the reference voltage Vref, and thus, the sensor amplifiers SA1, SA2, SA3, and SA4 turn on the regulating transistors M1, M2, M3, and M4, respectively.

As the voltage of the power source increases enough to turn on the first LED group, LED1 (or Group 1), that is located immediately downstream of the power source, the first regulating circuit, i.e., UHV1, M1, and SA1, conducts and the current i1 flows to the ground. Note that the first current regulating circuit may be turned on before, at, or after the rectified voltage Vrect reaches a level enough to power LED1. The same analogy applies to other regulating circuits corresponding to Groups 2-4. When Vrect is high enough to power LED1 but not enough to turn on LED2, the sensor amplifier SA1 compares the voltage level V1 with the reference voltage Vref and sends a control signal to the regulating transistor, M1. More specifically, the output signal of the sensor amplifier SA1 is input to the gate of the regulating transistor M1.

As Vrect increases, it reaches a level enough to power LED1 and LED2. Then, the second regulating circuit (i.e., UHV2, M2, and SA2) conducts, and LED1 and LED2 are turned on. As discussed above, the second current regulating circuit may be turned on before, at, or after Vrect reaches the level enough to power LED1 and LED2. The sensor amplifier SA2 compares the voltage level V2 with Vref and sends a control signal to the regulating transistor, M2.

When the second current regulating circuit is on, the overall efficiency of the driver 10 will be enhanced if the current i1 is cut off (or, set to a minimal level). It is because LED2 would produce more light if more current flows therethough, and, cutting off (or reducing) the current i1 would cause the current i1 to be redirected to LED2. In the driver 10, as the current i2 starts flowing, the voltage V1 further increases and exceeds Vref at some point in time. At this point, the SA1 sends a signal to M1, to thereby shut off the current i1.

Same analogy applies for subsequent groups. Generally speaking, when a downstream LED group is turned on and the current regulating circuit associated with the downstream group conducts, the current regulating circuit associated with upstream groups can be turned off (or, the current flowing through the regulating circuit is set to a minimal level) to enhance the overall efficiency of the driver circuit 10.

Once the source voltage (or the rectified voltage Vrect) reaches its peak and starts descending, the above process reverses so that the first current regulating circuit turns back on last. Note that as the source voltage decreases to a level insufficient to keep the downstream group on, the downstream group is naturally turned off even though its associated regulating circuit might be on.

As discussed above, each regulating circuit includes two transistors, such as UHV1 and M1, arranged in series to form a cascode structure. The cascode structure, which is implemented as a current sink, has various advantages compared to a single transistor current sink. First, it has enhanced current driving capability. When operating in its saturation region, which is desired for a current sink, the current driving capability (Idrv) of an LV/MV/HV NMOS is far superior to an UHV NMOS. For example, Idrv of a typical LV NMOS is 500 μA/μm whereas that of a typical UHV NMOS is 10~20 μA/μm. Thus, to regulate the same amount of current flow, the required projection area of an UHV NMOS on the chip is at least 20 times as large as that of an LV NMOS. Also, a typical UHV NMOS has the minimum channel length of 20 μm, while a typical LV NMOS has the minimum channel length of 0.5 μm. However, a typical LV NMOS requires a shielding mechanism that offers protection from high voltages. In the cascode structure, the first transistor, preferably UHV NMOS, operates as a shielding transistor, while the second transistor, preferably LV/MV/HV NMOS, operates as a current regulator, providing enhanced current driving capability. The shielding transistor is not operating in saturation region as would be in the case where a single UHV NMOS is used as the current sink and operated in the linear region. As such, the current driving capability Idrv is not the determinative design factor; rather the resistance of the shielding transistor, Rdson, is the important factor in designing the UHV NMOS of the cascode.

Second, due to the series configuration of the cascode structure, the required voltage (a.k.a. voltage compliance or voltage headroom) of the cascode structure can be higher than a single UHV NMOS configuration. For an LED driver case, however, the power loss due to the required voltage is much less than the power loss due to the LED driving voltage. For example, in an AC-driven LED driver case, the LED driving voltage (voltage on the LED anode) ranges 100 Vmrs~250 Vrms. Assume the required voltage of a single UHV NMOS is 2V whereas that of a cascode structure is 5V. In this case, the efficiencies are 98~99% and 95~98%, respectively. Of course, Rdson can be reduced so that the required voltage of the cascode structure can be about the same as that of a single UHV NMOS. The point is that the additional power consumed by the cascode structure is a minor disadvantage. If efficiency is a crucial design factor, the cascode structure can be designed in a current mirror configuration whereas a current mirror configuration using two UHV NMOS transistors is not practically feasible due to their large area on the chip.

Third, turning on/off the current sink is easier in the cascode structure since the UHV MOS and LV/MV/HV NMOS are controlled separately. In a single UHV NMOS current sink, both current regulation and on/off action have to be done by controlling the gate of the UHV NMOS, which has the characteristics of a large capacitor. In contrast, in the cascode structure, the current regulation can be done by controlling the LV/MV/HV NMOS and on/off action can be done by controlling the UHV NMOS that requires only logic operation applied on the gate.

Fourth, the speed of turning on/off is controlled more smoothly in the cascode structure than a single UHV NMOS configuration. In a single UHV NMOS configuration, the linear control of current cannot be easily achieved by controlling the gate voltage since the current is a square function of the gate voltage. By contrast, in a cascode structure, when the gate of the LV/MV/HV NMOS is controlled, the current control (slewing) becomes smoother since it is operating as a resistor that is an inverse function of the gate voltage.

Fifth, the cascode structure provides better noise immunity. Noise from the power supply can propagate through the LEDs and subsequently can be coupled to the current regulating circuit. More specifically, the noise is introduced into the feedback loop of the current regulating circuit. In a single UHV NMOS configuration, this noise is directly coupled to this loop, whereas, in a cascode structure, the noise is attenuated by the ratio of Rdson of the UHV NMOS to the effective resistance of the LV/MV/HV NMOS.

Sixth, the noise generated by a cascode structure is lower than a single UHV NMOS configuration. In the cascode structure, the current control is mainly performed by the regulating transistor, while, in a single UHV NMOS configuration, the current control is performed by the UHV NMOS. Since the gate capacitance of the LV/MV/HV NMOS is lower than the UHV NMOS, the noise generated by the cascode structure is lower than a single UHV NMOS configuration.

It is noted that the shielding transistors UHV1~UHV4 may be identical or different from each other. Likewise, the regulating transistors M1~M4 may be identical or different from each other. The specifications of the shielding and regulating transistors may be selected to meet the designer's objectives.

Figure 2:
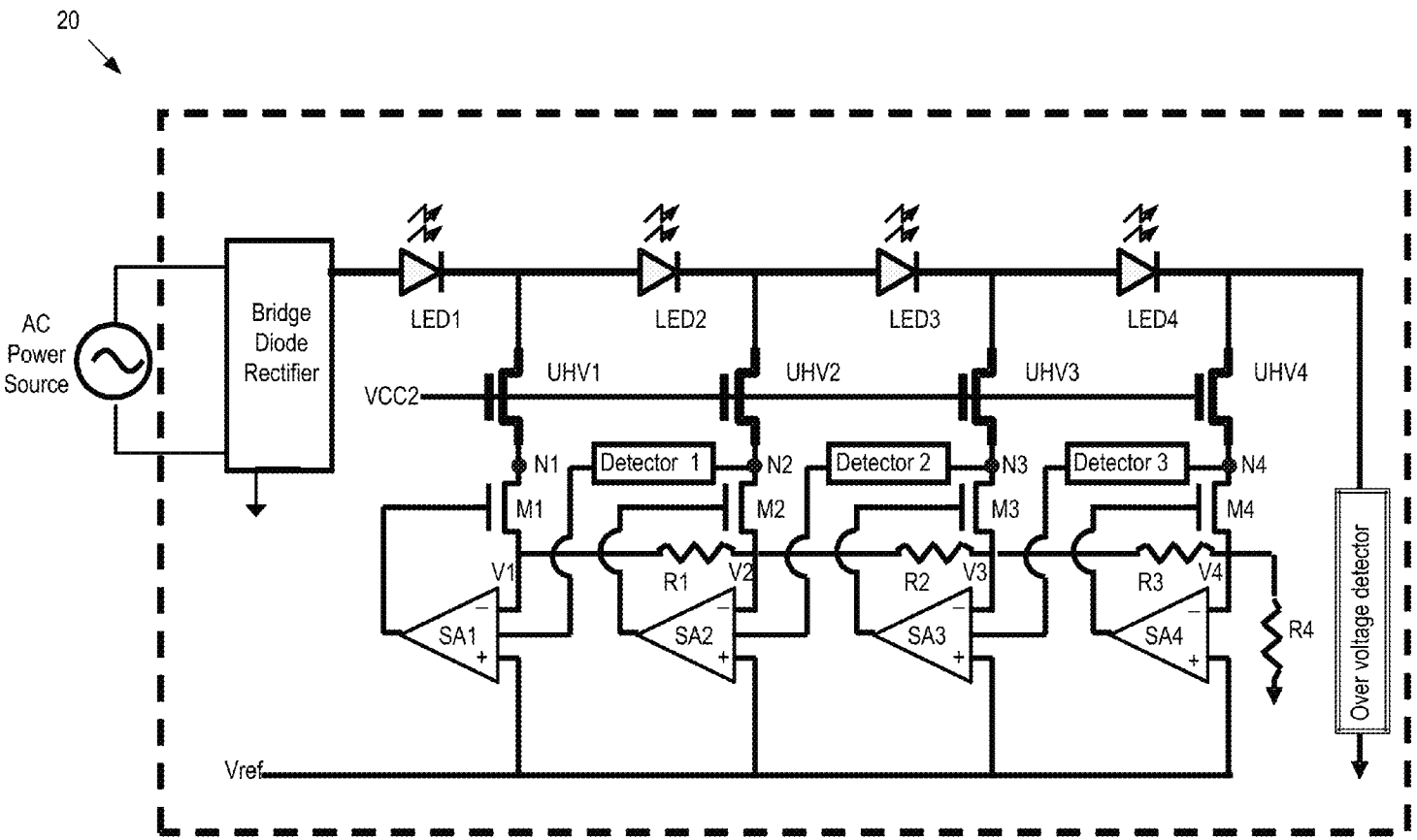
FIG. 2 shows a schematic diagram of an LED driver circuit in accordance with another embodiment of the present invention.

FIG. 2 shows a schematic diagram of an LED driver circuit 20 in accordance with another embodiment of the present invention. As depicted, the driver circuit 20 is similar to the driver circuit 10 in FIG. 1, the difference being that detector 1, detector 2, and detector 3 are used to detect the voltages at the nodes N2, N3, and N4, respectively. Each detector can be an operational amplifier, an inverter, (logic gate), or a Schmitt trigger, for instance. Each detector sends a signal to the sensor amplifier associated with the upstream LED group to thereby control the current flowing through the current regulating circuit. For instance, when the rectified voltage Vrect is high enough to turn on the LED1 and LED2, the detector 1 monitors the voltage level at the node N2. As the voltage at the node N2 further increases to reach a preset voltage level, the detector 1 sends a signal to the sensor amplifier SA1. Subsequently, the sensor amplifier SA1 turns off the current i1 (or, set the current i1 to a minimal level) by controlling the gate voltage of the regulating transistor M2. Once Vrect reaches its peak level and descends, the above process reverses.

The same analogy applies to the other detectors. For instance, the detector 2 monitors the voltage level at the node 3 and sends a signal to the sensor amplifier SA2 to control the current flow i2. It is noted that the sensor amplifier SA2 also compares the reference voltage Vref to the voltage V2 to control the gate voltage of the regulating transistor M2. Thus, the sensor amplifier SA2 takes three input voltages to control the current flow i2; the voltage level at the node N3, the voltage V2 at the downstream end of the regulating transistor M2, and the reference voltage Vref.

Figure 3:
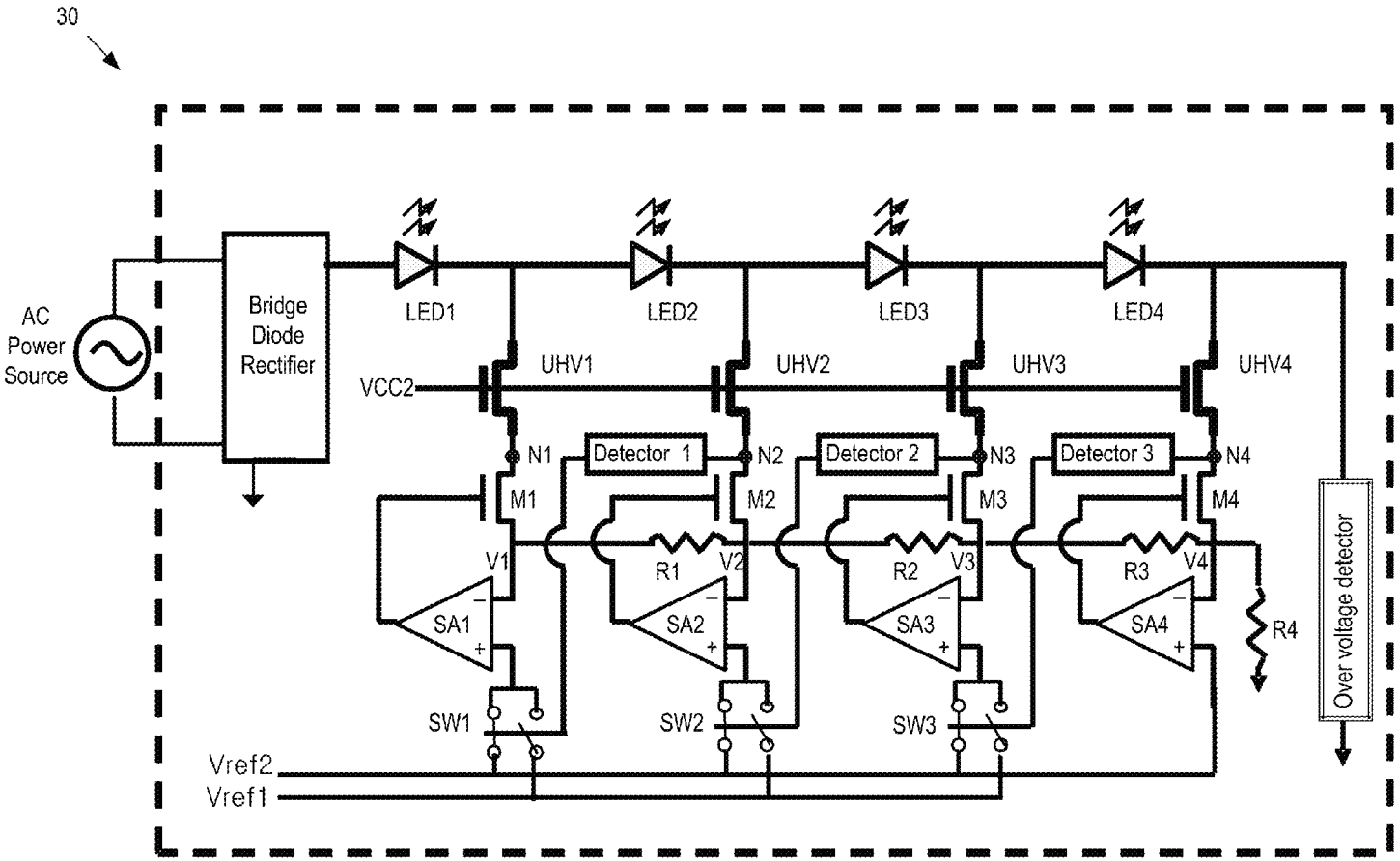
FIG. 3 shows a schematic diagram of an LED driver circuit in accordance with another embodiment of the present invention.

FIG. 3 shows a schematic diagram of an LED driver circuit 30 in accordance with another embodiment of the present invention. As depicted, the driver circuit 30 is similar to the driver circuit 20, the difference being that the signals from the detector 1~detector 3 are used to select the reference voltage of the sensor amplifier of the upstream group. For example, the first reference voltage Vref1 is lower than the second reference voltage Vref2. When the voltage level at the node N3 reaches a preset level, detector 2 sends a signal to the switch SW2 so that the reference voltage is switched from Vref2 to Vref1. Then, the output signal of the sensor amplifier SA2 is changed to turn off the regulating transistor M2.

Figure 4:
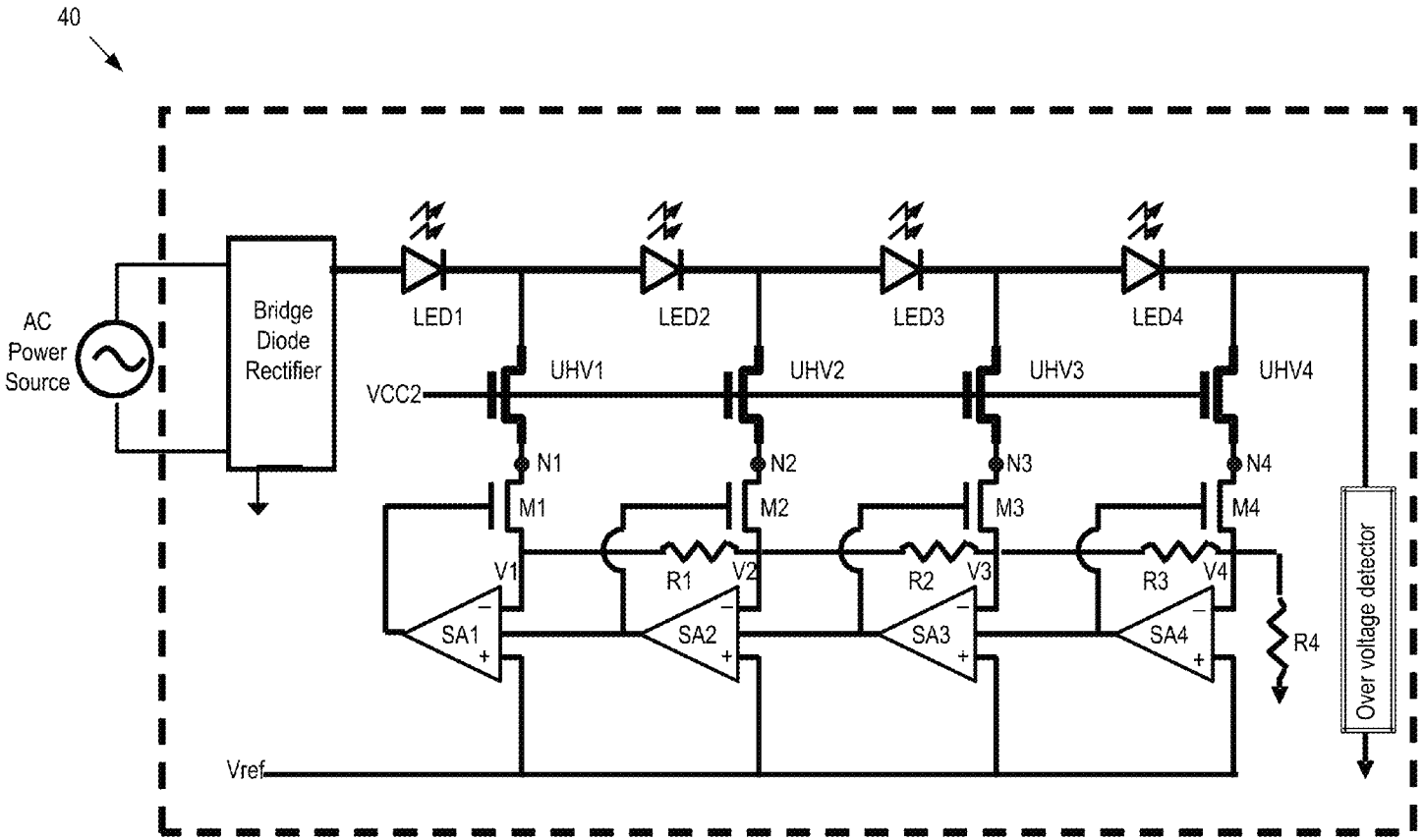
FIG. 4 shows a schematic diagram of an LED driver circuit in accordance with another embodiment of the present invention.

FIG. 4 shows a schematic diagram of an LED driver circuit 40 in accordance with another embodiment of the present invention. As depicted, the driver circuit 40 is similar to the driver circuit 10, the difference being that the output signal of a sensor amplifier, say SA2, is input to the upstream sensor amplifier, say SA1. For example, when the voltage V2 reaches a preset level, the sensor amplifier SA2 sends a signal to the sensor amplifier SA1, and subsequently, the sensor amplifier SA1 decreases its output voltage level so that the regulating transistor M1 turns off the current flow i1.

Figure 5:
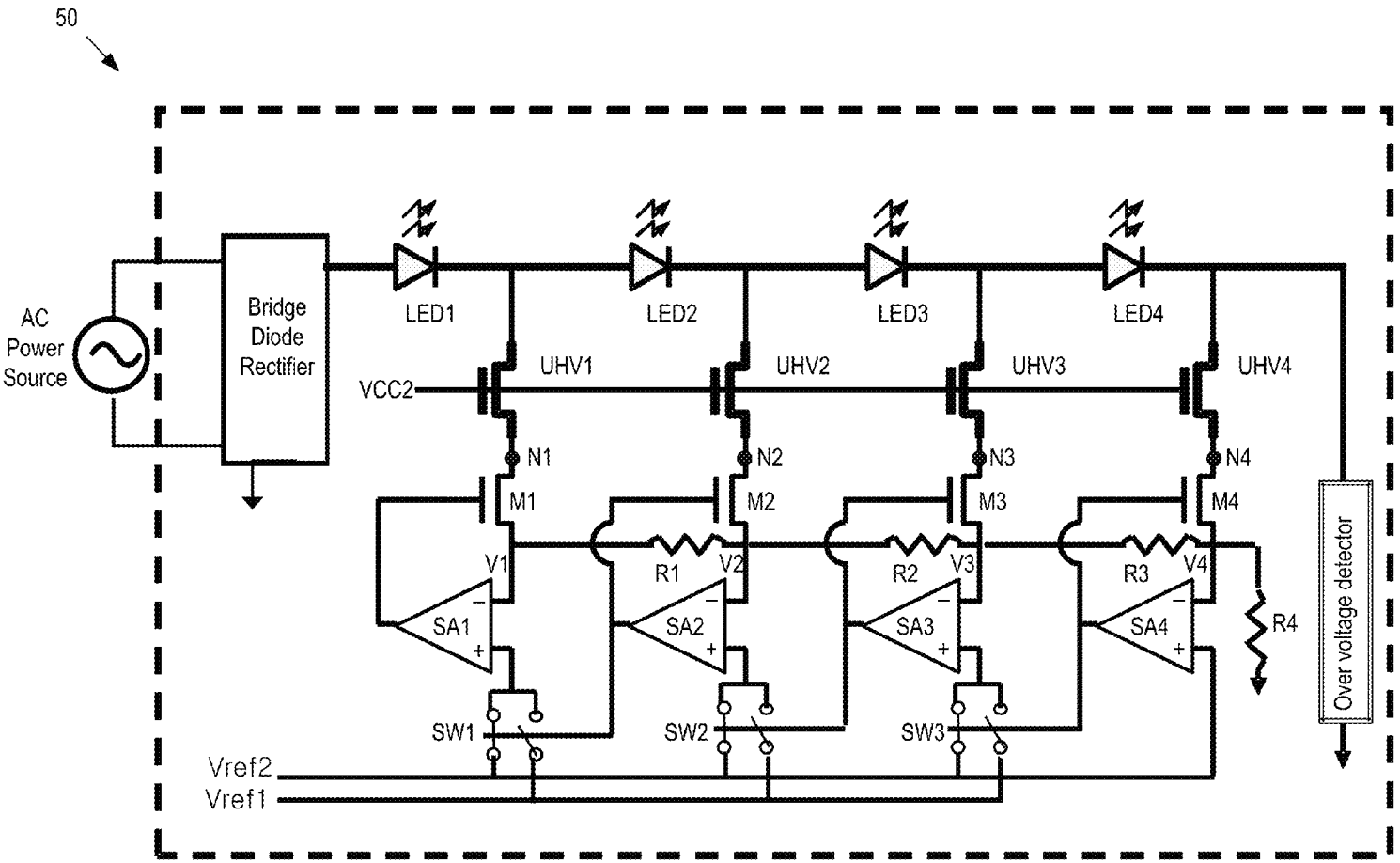
FIG. 5 shows a schematic diagram of an LED driver circuit in accordance with another embodiment of the present invention.

FIG. 5 shows a schematic diagram of an LED driver circuit 50 in accordance with another embodiment of the present invention. As depicted, the driver circuit 50 is similar to the driver circuit 10, with the difference that the reference voltage of the sensor amplifiers SA1~SA3 are switched between Vref1 and Vref2 and that the switching is triggered by the output signal of the downstream sensor amplifier. For example, the first reference voltage Vref1 is lower than the second reference voltage Vref2. When the voltage V2 reaches a preset level, the sensor amplifier SA2 sends a signal to the switch SW1 so that the non-inverting voltage of the sensor amplifier SA1 is switched to Vref1. Then, the output voltage of the sensor amplifier SA1, which is input to the Vref2 (or Vref1) as non-inverting input, is lowered to turn off the regulating transistor M1.

Figure 6:
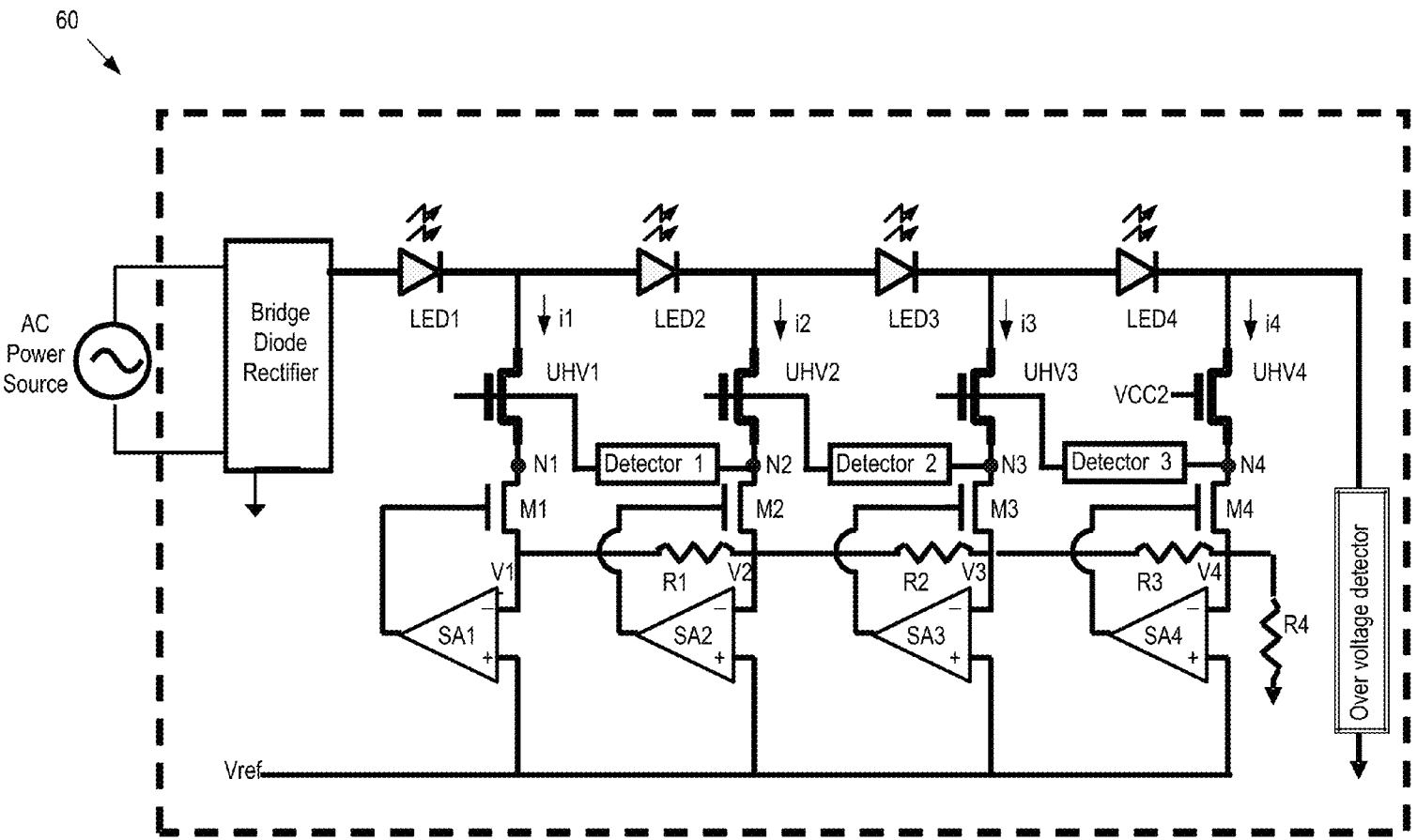
FIG. 6 shows a schematic diagram of an LED driver circuit in accordance with another embodiment of the present invention.

FIG. 6 shows a schematic diagram of an LED driver circuit 60 in accordance with another embodiment of the present invention. As depicted, the driver circuit 60 is similar to the driver circuit 20 in FIG. 2, the difference being that the output pin of each of the detectors is connected to the gate of the first transistor of the upstream current regulating circuit. Each detector sends an output signal to the gate of the first (or, shielding) transistor associated with the upstream LED group to thereby control the current flowing through the current regulating circuit. For instance, when the rectified voltage Vrect is high enough to turn on LED1 and LED2, the detector 1 monitors the voltage level at the node N2. As the voltage at the node N2 further increases to reach a preset voltage level, the detector 1 sends an output signal to the gate of UHV1. Subsequently, UHV1 turns off the current i1 (or, set the current i1 to a minimal level).

The same analogy applies to the other detectors. For instance, the detector 2 monitors the voltage level at the node 3 and sends an output signal to UHV2 to control the current flow i2. It is noted that UHV4, the first transistor of the current regulating circuit associated with LED4, the last LED group, has a constant gate voltage Vcc2.

Figure 7:
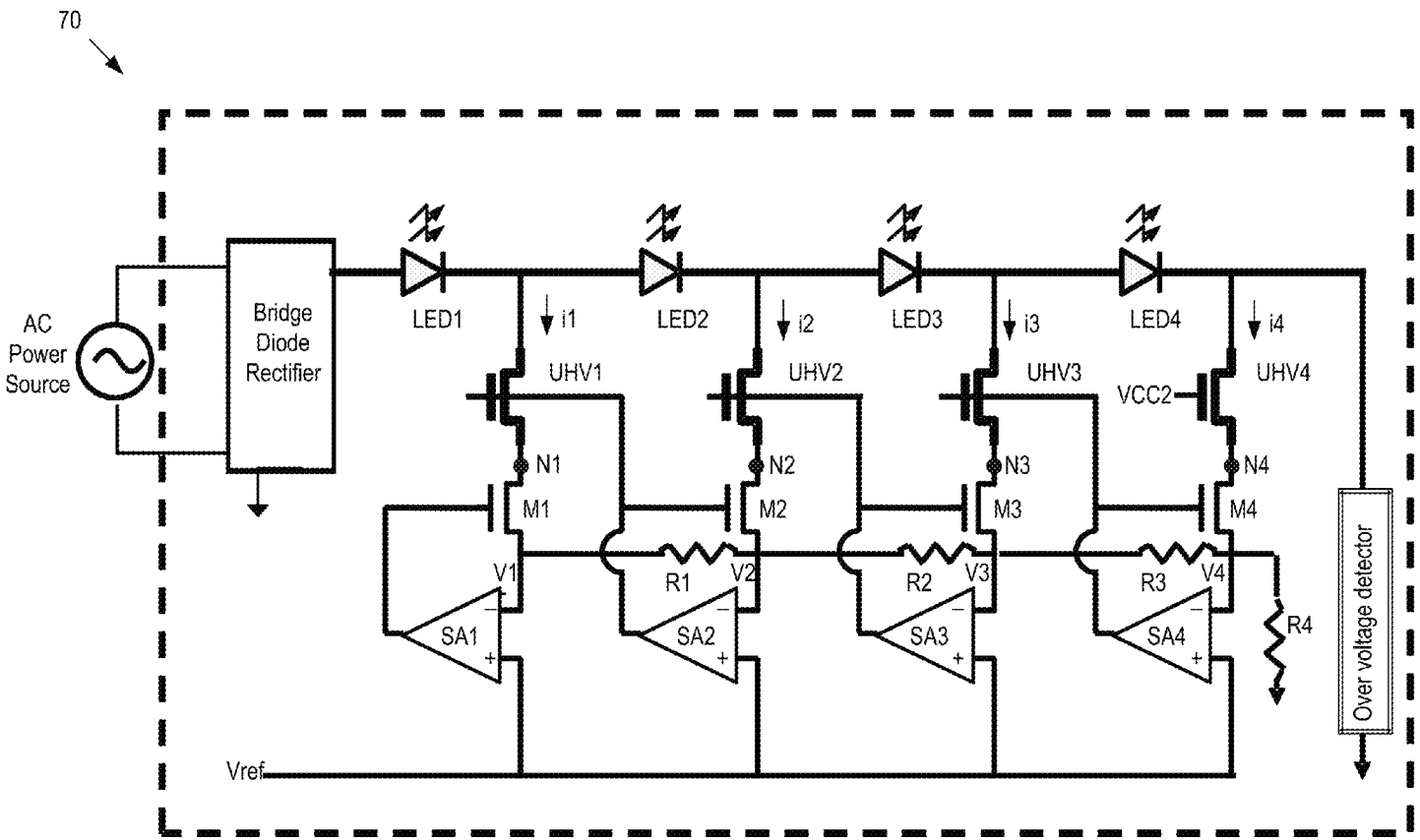
FIG. 7 shows a schematic diagram of an LED driver circuit in accordance with another embodiment of the present invention.

FIG. 7 shows a schematic diagram of an LED driver circuit 70 in accordance with another embodiment of the present invention. As depicted, the driver circuit 70 is similar to the driver circuit 10 in FIG. 1, the difference being that the output pin of a sensor amplifier is connected to the gate of the first transistor of the upstream current regulating circuit, to thereby control the current flowing through the upstream current regulating circuit. For instance, when the rectified voltage Vrect is high enough to turn on the LED 1 and LED2, the sensor amplifier SA2 sends an output signal to the gate of UHV1. Subsequently, UHV1 turns off the current i1 (or, set the current i1 to a minimal level).

The same analogy applies to the other sensor amplifiers. For instance, the sensor amplifier SA3 sends an output signal to UHV2 to control the current flow i2. It is noted that UHV4, the first transistor of the current regulating circuit associated with LED4, the last LED group, has a constant gate voltage Vcc2.

Figure 8A:
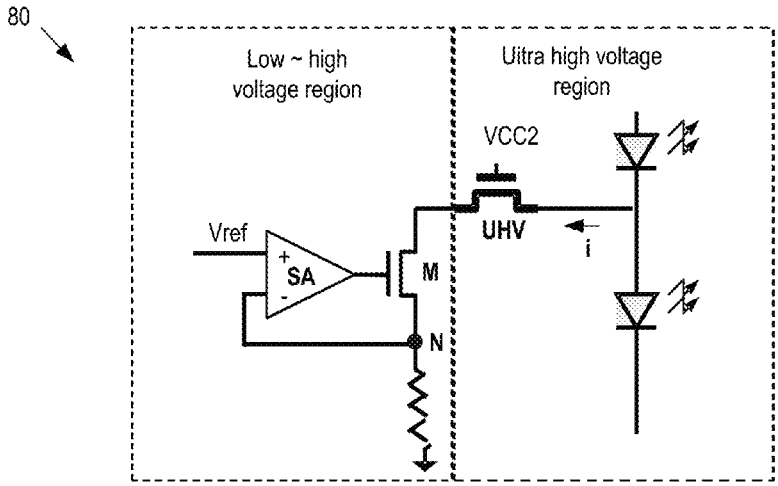
FIG. 8A-8C show schematic diagrams of circuits for controlling the current flowing through a transistor in accordance with another embodiment of the present invention.

FIG. 8A shows a schematic diagram of a circuit 80 for controlling the current i flowing through a regulating transistor M, where the circuit 80 is included in the driver circuits 10-70. As depicted, the sensor amplifier SA compares the reference voltage Vref to the voltage level at the node N and sends a signal to the gate of the regulating transistor M to control the current i. The types and operational mechanisms of the components of the circuit 80 are described in conjunction with FIG. 1. For example, the regulating transistor M can be LV/MV/HV NMOS, while the shielding transistor can be UHV NMOS. For brevity, the description of other components is not repeated.

Figure 8B:
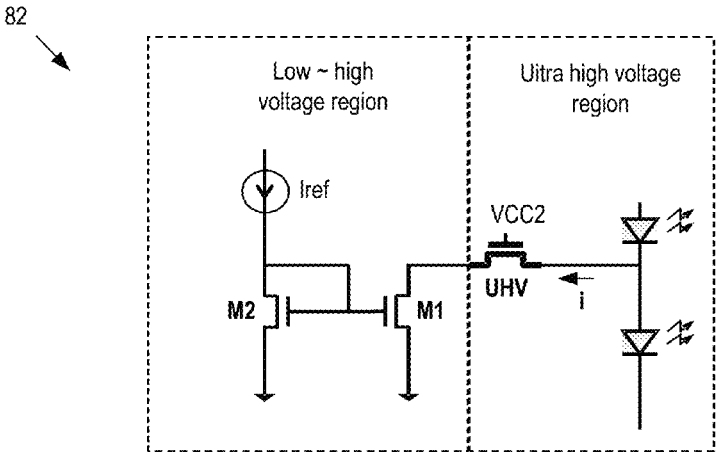

FIG. 8B shows a schematic diagram of a circuit 82 for controlling the current i flowing through a regulating transistor M1 in accordance with another embodiment of the present invention. As depicted, another transistor M2, which is identical to the regulating transistor M1, is connected to the regulating transistor M1 to form a current mirror configuration. More specifically, the gates of the two transistors M1, M2 are electrically connected to each other to have the same gate voltage. The current Iref flowing through the second transistor M2 is controlled to regulate the current i flowing through the regulating transistor M1. The current regulating circuit 82 may be used in place of the current regulating circuit 80 of FIG. 8A, and as such, the current regulating circuit 82 may be used in the driver circuits of FIGS. 1-7. Furthermore, the current Iref may be varied from one level to another to have the effect of switching the reference voltage from Vref1 to Vref2 in the driver circuits 30 and 50.

Figure 8C:
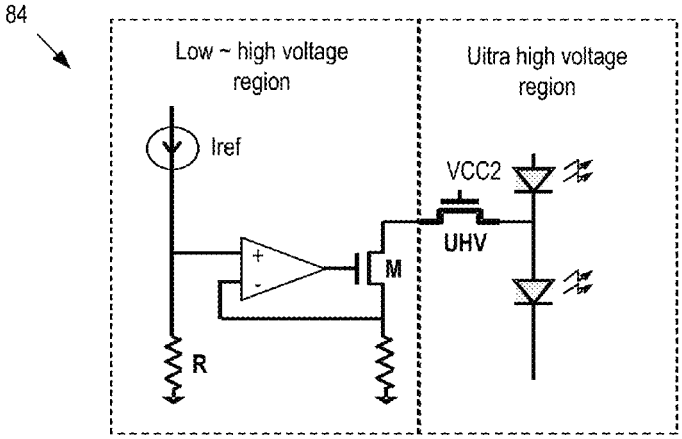

FIG. 8C shows a schematic diagram of a circuit 84 for controlling the current i flowing through a regulating transistor M in accordance with another embodiment of the present invention. As depicted, the sensor amplifier SA is provided with a non-inverting input voltage Vref, where Vref is determined by the equation:

$$Vref=Iref*R,$$

where Iref and R represent current and resistor, respectively.

The current regulating circuit 84 may be used in place of the current regulating circuit 80 of FIG. 8A. As such, the current regulating circuit 84 may be used in the driver circuits of FIGS. 1-7. Furthermore, the current Iref may be changed from one level to another to have the effect of switching the reference voltage from Vref1 to Vref2 in the driver circuits 30 and 50.

It is noted that only two reference voltages Vref1 and Vref2 are used for each switch of the driver circuits 30 and 50. However, it should be apparent to those of ordinary skill in the art that more than two references voltages may be used for each switch.

Figure 9:
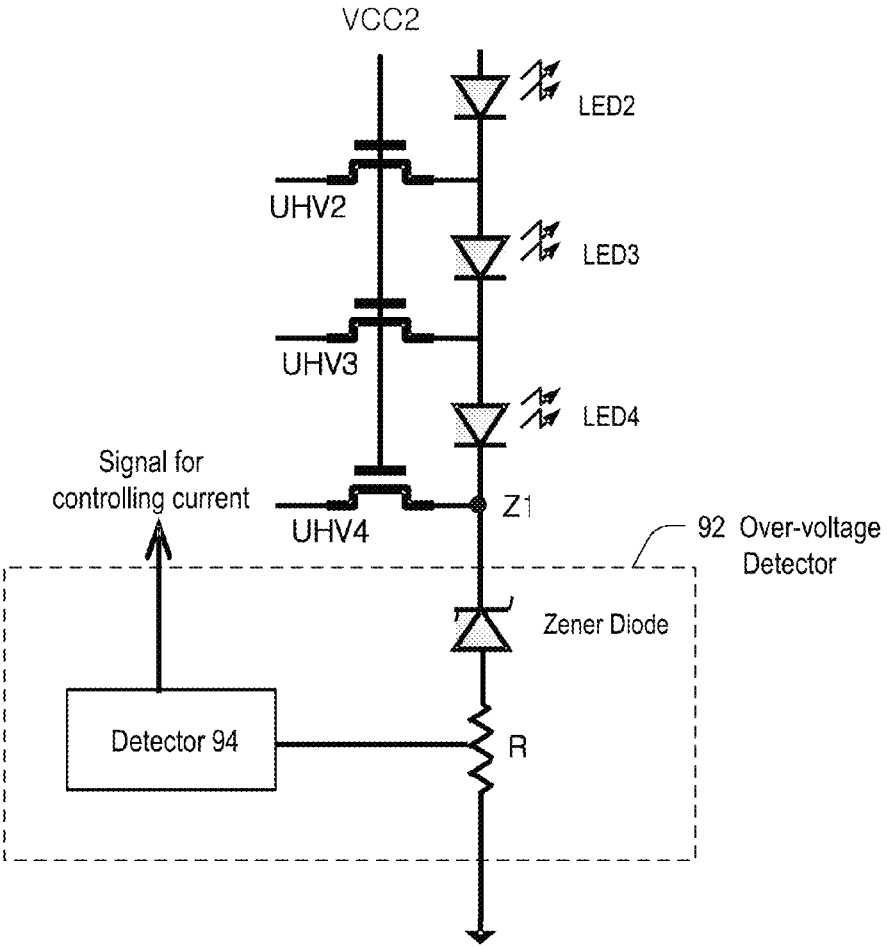
FIG. 9 shows a schematic diagram of an over-voltage detector in accordance with another embodiment of the present invention.

FIG. 9 shows a schematic diagram of an over-voltage detector 92 in accordance with another embodiment of the present invention. As depicted, the over-voltage detector 92 may include: a Zener diode connected to the downstream end of the last LED group; a detector 94 for detecting voltage; and a sensing resistor R. The voltage level at the node Z1 equals the voltage difference between Vrect and the voltage drop by the string of LEDs. When the voltage level at Z1 exceeds a preset level, which is preferably the breakdown voltage of the Zener diode, the current flows through the sensing resistor R. Then, a detector 94 detects the voltage level and sends a signal to a proper component of the driver circuit to thereby control the current flowing through the LEDs, i.e., to cut off the current flowing through the LEDs or to prevent the excess power dissipation in the chip that contains the driver circuits. For example, the output signal of the over-voltage detector 92 is input to the SA4 in FIG. 1 so that the current i4 is cut off. In another example, the output signal is sent to a component (not shown in FIG. 1) that generates the reference voltage Vref so that the component may reduce the Vref in FIG. 1. In still another example, the output signal is used to lower the gate voltage Vcc2 of the shielding transistors UHVs. It is noted that the over-voltage detector 92 may be also used in the driver circuits of FIG. 1-7.

Figure 10A:
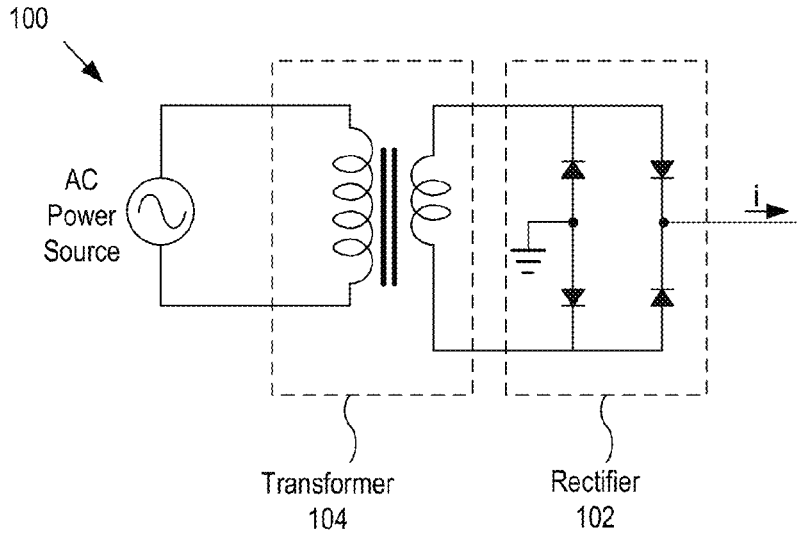
FIGS. 10A-10B show schematic diagrams of input power generators in accordance with another embodiment of the present invention.
Figure 10B:
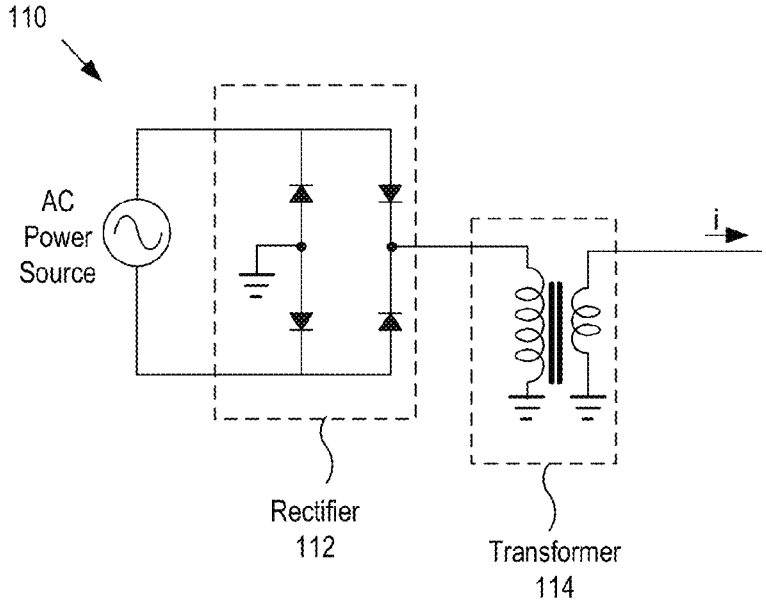

As depicted in FIGS. 1-7, each driver may include a rectifier to rectify the current supplied by an AC power source. In certain applications, such as high power LED street lights, the LEDs may demand high power consumption. In such applications, the driver may be isolated from the AC power source by a transformer for safety purposes. FIGS. 10A-10B show schematic diagrams of input power generators 100 and 110 in accordance with another embodiment of the present invention. As depicted in FIG. 10A, a transformer 104 may be disposed between AC input and the rectifier 102. Alternatively, a rectifier 112 may be disposed between AC input source and the transformer 114, as depicted in FIG. 10B. In both cases, the current i flows through one or more of the LED groups during operation. The input power generators 100 and 110 may be applied to the drivers of FIGS. 1-7.

It should be understood, of course, that the foregoing relates to exemplary embodiments of the invention and that modifications may be made without departing from the spirit and scope of the invention as set forth in the following claims.

What is claimed is:

1. A method for driving light emitting diodes (LEDs), comprising:

providing a string of LEDs divided into groups, the groups being electrically connected to each other in series;

providing a power source electrically connected to the string of LEDs;

coupling each of the groups to a ground through a current regulating circuit, the current regulating circuit including a cascode structure having first and second transistors, a source of the first transistor being directly connected to a drain of the second transistor so that the source of the first transistor and the drain of the second transistor have a same voltage potential during operation; and increasing an input voltage from the power source to turn on the groups in a downstream sequence.

2. A method as recited in claim 1, wherein the current regulating circuit includes a third transistor identical to the second transistor and a gate of the second transistor is directly connected to a gate of the third transistor to thereby form a current mirror, further comprising:

regulating a current flowing through the second transistor by varying a current flowing through the third transistor.

3. A method as recited in claim 1, further comprising:

disposing a Zener diode and a resistor in series between a downstream end of the string of LEDs and the ground;

causing a detector to monitor a voltage level at a point of the resistor;

causing the detector to send an output signal when a current flows though the Zener diode; and controlling, based on the output signal of the detector, a current flowing through the string of LEDs.

4. A method as recited in claim 3, wherein the step of controlling a current includes:

causing a sensor amplifier to receive the output signal of the detector; and causing the sensor amplifier to send a signal to a gate of the second transistor.

5. A method as recited in claim 3, wherein the step of controlling a current includes:

changing a reference voltage based on the output signal of the detector; and inputting the changed reference voltage to a sensor amplifier, wherein an output signal of the sensor amplifier is directly input to a gate of the second transistor.

6. A method as recited in claim 3, wherein the step of controlling a current includes:

changing the gate voltage of the first transistor by use of the output signal of the detector.

7. A method as recited in claim 1, further comprising:

applying a gate voltage to a gate of the first transistor; and regulating a current flowing through the second transistor by varying a gate voltage of the second transistor, wherein the current flowing through the second transistor of an upstream group is reduced to a minimal level or turned off when a current of a next group downstream of the upstream group reaches a preset level.

8. A method as recited in claim 7, wherein the step of applying a gate voltage to a gate of the first transistor includes:

maintaining the gate voltage applied to the gate of the first transistor at a substantially constant level.

9. A method as recited in claim 7, wherein the step of applying a gate voltage to a gate of the first transistor includes:

causing a detector to monitor a drain voltage of the second transistor of a downstream group; and causing the detector to send an output signal to the gate of the first transistor of a next group upstream of the downstream group.

10. A method as recited in claim 7, wherein the current regulating circuit includes a sensor amplifier and wherein the step of applying a gate voltage to a gate of the first transistor includes:

causing the sensor amplifier of a downstream group to send an output signal to the gate of the first transistor of a next group upstream of the downstream group.

11. A method as recited in claim 7, wherein the current regulating circuit includes a sensor amplifier and wherein the step of regulating a current flowing through the second transistor includes:

inputting a reference voltage to the sensor amplifier; and causing the sensor amplifier to send an output signal to a gate of the second transistor to thereby regulate the current flowing through the second transistor.

12. A method as recited in claim 11, further comprising, prior to the step of causing the sensor amplifier to send an output signal:

causing a detector to monitor a drain voltage of the second transistor of a downstream group; and causing the detector to send an output signal to the sensor amplifier of a next group upstream of the downstream group.

13. A method as recited in claim 11, further comprising, prior to the step of inputting the reference voltage:

providing first and second substantially constant voltages;

causing a detector to monitor a drain voltage of the second transistor of a downstream group;

causing the detector to send an output signal when the drain voltage reaches a preset level; and selecting, based on the output signal of the detector, one of the first and second substantially constant voltages as the reference voltage of the sensor transistor of a next group upstream of the downstream group.

14. A method as recited in claim 11, further comprising, after the step of causing the sensor amplifier to send an output signal:

causing the sensor amplifier of a downstream group to send the output signal to the sensor amplifier of a next group upstream of the downstream group.

15. A method as recited in claim 11, further comprising, prior to the step of inputting the reference voltage:

providing first and second substantially constant voltages;

causing the sensor amplifier of a downstream group to send an output signal; and selecting, based on the output signal of the sensor amplifier of the downstream group, one of the first and second substantially constant voltages as the reference voltage of the sensor amplifier of a next group upstream of the downstream group.

16. A method as recited in claim 11, further comprising, prior to the step of inputting a reference voltage:

causing a reference current to flow through a resistor; and taking the voltage difference across the resistor as the reference voltage.

17. A driver circuit for driving light emitting diodes (LEDs), comprising:

a string of LEDs divided into n groups, the n groups of LEDs being electrically connected to each other in series, a downstream end of group m−1 being electrically connected to the upstream end of group m, where m being a positive number equal to or less than n;

a plurality of current regulating circuits, each of the current regulating circuits being coupled to the downstream end of a corresponding group and a ground and including an amplifier and a cascode having first and second transistors, a source of the first transistor being directly connected to a drain of the second transistor so that the source of the first transistor and the drain of the second transistor have a same voltage potential during operation.

18. A driver as recited in claim 17, wherein each of the groups includes one or more LEDS and resistors of the same or different kind, color, and value, connected in parallel or in series or combination thereof.

19. A driver as recited in claim 17, wherein the first transistor is an ultra-high-voltage (UHV) transistor and is a N-Channel MOSFET, a P-Channel MOSFET, a NPN bipolar transistor, a PNP bipolar transistor, or an Insulated gate bipolar Transistor (IGBT).

20. A driver as recited in claim 17, wherein the second transistor is a low-voltage, a medium voltage, or a high voltage transistor and is a N-Channel MOSFET, a P-Channel MOSFET, a NPN bipolar transistor, a PNP bipolar transistor, or an Insulated gate bipolar Transistor (IGBT).

21. A driver as recited in claim 17, further comprising:

a plurality of detectors, each of the detectors being adapted to detect a source voltage of the first transistor of the current regulating circuit corresponding to group m and to send a signal to the amplifier of the current regulating circuit corresponding to group m−1.

22. A driver as recited in claim 17, further comprising:

a plurality of switches, each of the switches being adapted to switch between two reference voltages and connected to the amplifier of a corresponding current regulating circuit; and a plurality of detectors, each of the detectors being adapted to detect a source voltage of the first transistor of the current regulating circuit corresponding to group m and to send a signal to the switch corresponding to group m−1.

23. A driver as recited in claim 17, wherein an output pin of the amplifier of the current regulating circuit corresponding to group m is directly connected to the amplifier of group m−1.

24. A driver as recited in claim 17, wherein an output pin of the amplifier of the current regulating circuit corresponding to group m is directly connected to the amplifier of group m−1, further comprising:

a plurality of switches, each of the switches being adapted to switch between two reference voltages and connected to the amplifier of a corresponding current regulating circuit, wherein the output pin of the amplifier of the current regulating circuit corresponding to group m is connected to the switch corresponding to group m−1.

25. A driver as recited in claim 17, further comprising:

a plurality of detectors, each of the detectors being adapted to detect a source voltage of the first transistor of the current regulating circuit corresponding to group m and to send a signal to a gate of the first transistor of the current regulating circuit corresponding to group m−1.

26. A driver as recited in claim 17, wherein an output pin of the amplifier of the current regulating circuit corresponding to group m is directly connected to a gate of the first transistor of the current regulating circuit corresponding to group m−1.

27. A driver as recited in claim 17, wherein each of the current regulating circuits includes a third transistor identical to the second transistor and a gate of the third transistor is directly connected to a gate of the second transistor to form a current mirror.

28. A driver as recited in claim 17, wherein the amplifier of each of the current regulating circuits is connected to a voltage source for providing a reference voltage thereto and the voltage source includes a reference current source and a resistor.

29. A driver as recited in claim 17, further comprising:

a plurality of resistors, each of the resistors being disposed between a source of the second transistor of a corresponding group and the ground.

30. A driver as recited in claim 17, further comprising an over-voltage detector connected to a downstream end of the string of LEDs.

31. A driver as recited in claim 30, wherein the over-voltage detector includes a Zener diode, a resistor, and a detector adapted to detect a voltage at a point in the resistor.

32. A driver as recited in claim 17, further comprising a power source coupled to an upstream end of group 1 and operative to provide an input voltage.

33. A driver as recited in claim 32, wherein the power source includes a rectifier and a transformer.

* * * * *